United States Patent [19]

Moore

[11] 4,072,384

[45] Feb. 7, 1978

[54] LAMP SOCKET

[75] Inventor: Marvin W. Moore, Rochester, Mich.

[73] Assignee: Microdot Inc., Greenwich, Conn.

[21] Appl. No.: 746,215

[22] Filed: Dec. 1, 1976

Related U.S. Application Data

[63] Continuation of Ser. No. 599,064, July 25, 1975, abandoned.

[51] Int. Cl.[2] ..... H01R 13/40

[52] U.S. Cl. ..... 339/59 L; 339/95 R; 339/113 R; 339/188 R; 339/206 L

[58] Field of Search ..... 339/59-61, 339/88, 95, 113, 127, 128, 144-146, 188-190, 176, 191 L, 206 L

[56] References Cited

U.S. PATENT DOCUMENTS

| | | | |
|---|---|---|---|
| 1,383,764 | 7/1921 | Sargent | 339/188 R |
| 2,101,277 | 12/1937 | Wappler | 339/146 |
| 2,721,985 | 10/1955 | Gilbert | 339/25 |
| 2,982,939 | 5/1961 | Kirk | 339/127 |
| 3,105,730 | 10/1963 | Smith | 339/188 R |
| 3,286,088 | 11/1966 | Ahroni | 339/144 R |
| 3,497,865 | 2/1970 | Heath | 339/127 |
| 3,643,211 | 2/1972 | DeLano | 339/176 L |
| 3,805,211 | 4/1974 | Moore | 339/176 L |

FOREIGN PATENT DOCUMENTS

| | | | |
|---|---|---|---|
| 652,972 | 2/1963 | Italy | 339/95 T |
| 18,161 | 6/1928 | Netherlands | 339/188 R |
| 644,540 | 10/1950 | United Kingdom | 339/113 L |
| 986,417 | 3/1965 | United Kingdom | 339/128 |
| 999,232 | 7/1965 | United Kingdom | 339/128 |
| 1,116,371 | 6/1968 | United Kingdom | 339/176 L |

*Primary Examiner*—Joseph H. McGlynn
*Attorney, Agent, or Firm*—Harness, Dickey & Pierce

[57] ABSTRACT

The disclosure relates to a lamp socket having an improved core that facilitates assembly and improved contact of the light bulb with the terminals of the socket. The core is generally cylindrical in shape and has one or more passageways therein adapted to accept and retain complimentary spade terminals. A spring is positioned around the core in the socket housing to provide the necessary lost motion to maintain contact pressure. Locking tabs prevent separation of the core from the housing.

4 Claims, 10 Drawing Figures

LAMP SOCKET

This is a continuation of application Ser. No. 599,064, filed July 25, 1975, now abandoned.

BACKGROUND OF THE INVENTION

The present invention relates to an improved lamp socket for the reception of a lamp used as an automotive brake light, head light, parking light, turn signal and the like. In addition, the improved lamp socket has numerous uses and applications outside the automobile industry.

The lamp sockets used in automobiles and other vehicles today generally comprise a socket housing adapted to be securely fastened in a light fixture, a central core member positioned in the socket housing, a light bulb releasably secured in the socket housing, and at least one wire connected to the terminals of the core member. The wire leads to the wiring harness of the vehicle. The core member has one or more relatively movable metal contacts for mating with the contacts on the end of the light bulb. These contacts often consist of tubular members which are inserted in complimentary holes in the core member. A spring may be positioned around each of the tubular members to provide the requisite "lost motion" to maintain contact pressure between the bulb and core contacts.

Conventional lamp sockets are generally assembled by inserting the core member into the socket from the bulb-accepting end thereof. In most instances, wires are soldered or otherwise connected to the tubular members of the core members. The wires generally must be fed through the socket housing. The socket housings are then secured in place in the light fixtures in the vehicle.

Such known lamp sockets have numerous disadvantages. The core members consist of separate contacts creating unnecessary expense in both materials and assembly. The core member contacts provide a wipe-and-slide contact with the contacts on the bulbs which does not always clean the oxidation from the contacts and often results in a poor or unworkable electrical connection.

The present invention overcomes the aforementioned disadvantages. The core member of the improved lamp socket comprises one or more sections which, when assembled, are generally cylindrical in shape. Where a two-sectioned core member is provided, the sections fit together to form the cylindrical shape. The core member has at least one channel or passageway formed in to accept and fixedly secure at least one spade terminal in the core member. The core member is inserted into the socket housing from the bulb end thereof, locking tabs maintaining it in place. A spring is positioned around the core member to provide the needed "lost motion" with a bulb.

After the core member is fixed in the socket housing and the housing is secured in position in the light fixture, the appropriate wires from the wire harness are simply inserted into place in the core member. More specifically, spade terminals on the wire are merely inserted into complimentary slots in the core member from the end opposite from the bulb-accepting end of the housing. Tabs in the slots retain terminals securely in place. A light bulb is then positioned in the socket housing in the conventional manner, (lugs being accepted by J-shaped grooves).

The spade terminals have edge-like ends for making electrical contact with the contacts on the end of a light bulb. When a bulb is inserted into the sockets, (pushed down hard, turned slightly, and then released), the terminals make a wiping and cutting contact with the bulk contacts. This insures a good contact as the cutting action slices through whatever oxidation and film might exist on the bulb contacts.

Where the core member has two sections, each section may be made of a different color to insure mating with the proper wires in a wiring harness. Also, the two-sectioned core member permits relative movement between the sections to allow the spade terminals to make proper contact with uneven bulb terminals. Rear assembly of the wires is possible. Further, the present invention eliminates one element in the electrical circuit between the bulb and the wires in the wire harness and thus reduces the milivolt drop from the bulb to the wires.

The present invention can be used with either single or double contact bulbs. If the light fixture only utilizes a single contact bulb, a one-piece core member is utilized. Many of the features and advantages of the present invention are realized in this embodiment.

Further features and advantages of the present invention will become apparent from the following description, claims and drawings.

BRIEF DESCRIPTION OF THE DRAWINGS

The invention will be more clearly understood when the following description is viewed in accordance with the accompanying drawings, in which.

DESCRIPTION OF THE PREFERRED EMBODIMENT

Figure 1:
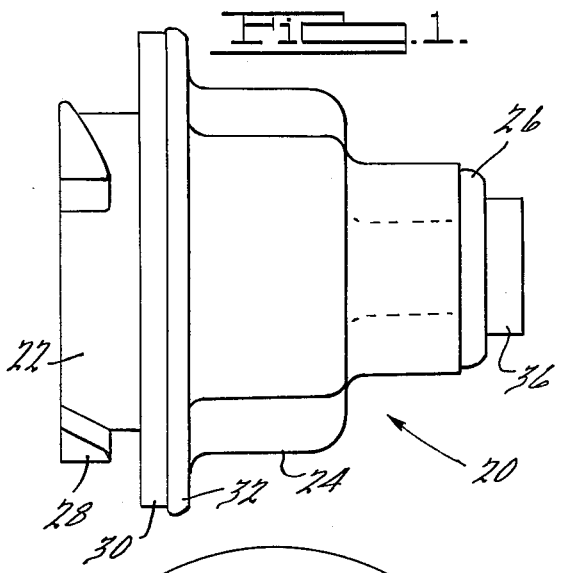
FIG. 1 is a side elevation of an improved lamp socket in accordance with the present invention.
Figure 2:
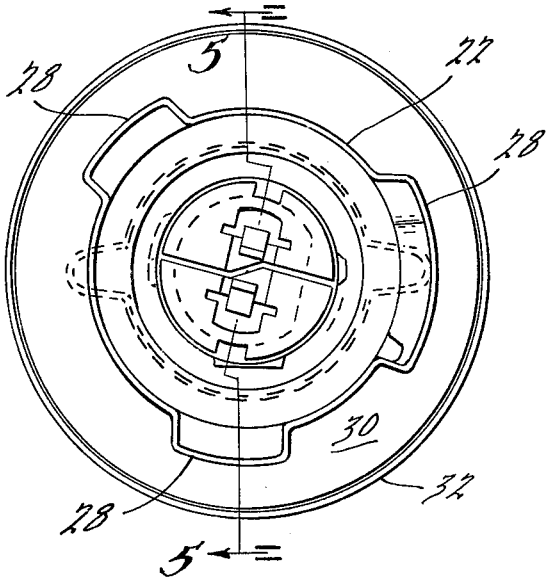
FIG. 2 is an end view of the socket shown in FIG. 1.
Figure 3:
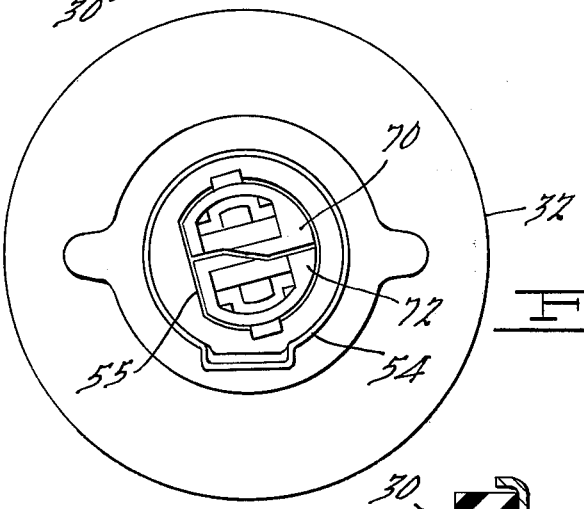
FIG. 3 is the other end view of the socket shown in FIG. 1.

A socket housing 20 used for the present invention is best shown in FIGS. 1, 5, 9 and 10. The socket housing 20 comprises a cup member 22, an outer generally cylindrical member 24, and an inner tubular member 26. Each of the three parts, 22, 24 and 26, are preferably stampings made of a relatively thin non-corrosive metal material, for example, aluminum or brass, although one or more parts could also be made of a plastic material. The three parts, 22, 24 and 26, are securely affixed together, for example, by welding, soldering, press-fitting or the like, to form a unitary housing 20.

The cup member 22 has a plurality of projections 28 on the outer circumference thereof which are adapted to mate with the light fixture (not shown) on the vehicle. Typically, the projections are formed so that when the housing 20 is inserted in a hole in the light fixture, it only needs to be rotated a few degrees to be seated in and firmly affixed to the fixture.

An annular washer or gasket 30 is provided to seal the housing 20 to the light fixture and also to insure against rattling and vibration. The gasket 30 can be made of any rubber or plastic material, but preferably, is made of a sponge-like rubber and is flexible enough to be deformed and to be put into position around the circumference of the cup member 22. The gasket 30 is seated against an outwardly extending flange element 32 on the outer member 24.

The inner tubular member 26 is adapted to mate with and hold the light bulb 34 (FIG. 10) and the core member 36. Suitable J-shaped or bayonet grooves 38 are provided on the inner surface of the member 26 for mating with the radially extending lugs or projections 40 which are provided on the sides of the bulb 34. In this matter, the bulb 34 is inserted in the open end of the tubular member 26 and releasably locked therein.

The electric bulb 34 is a standard type having a cylindrical base portion 44, a glass bulb portion 46, an electric filament portion 48, and one or more electric terminals or contacts 50 connected by wiring (not shown) extending through the base portion 44 to the filament portion 48.

The lower end of the inner tubular member 26 has an aperture 54 formed in it which is slightly greater than the outer diameter of the core member 36. The aperture 54 is circular in shape except for one straight section 55 which is provided to properly align the core member 36 in the socket housing 20. The generally cylindrically-shaped core member 36 has one flat surface 56 for mating with the straight section 55. The core member 36 must be properly positioned in the socket housing 20 so that the terminals in the core member 36 will come into contact with the appropriate terminals 50 on the bulb 34 and the bulb 34 will function in the intended manner.

Figure 5:
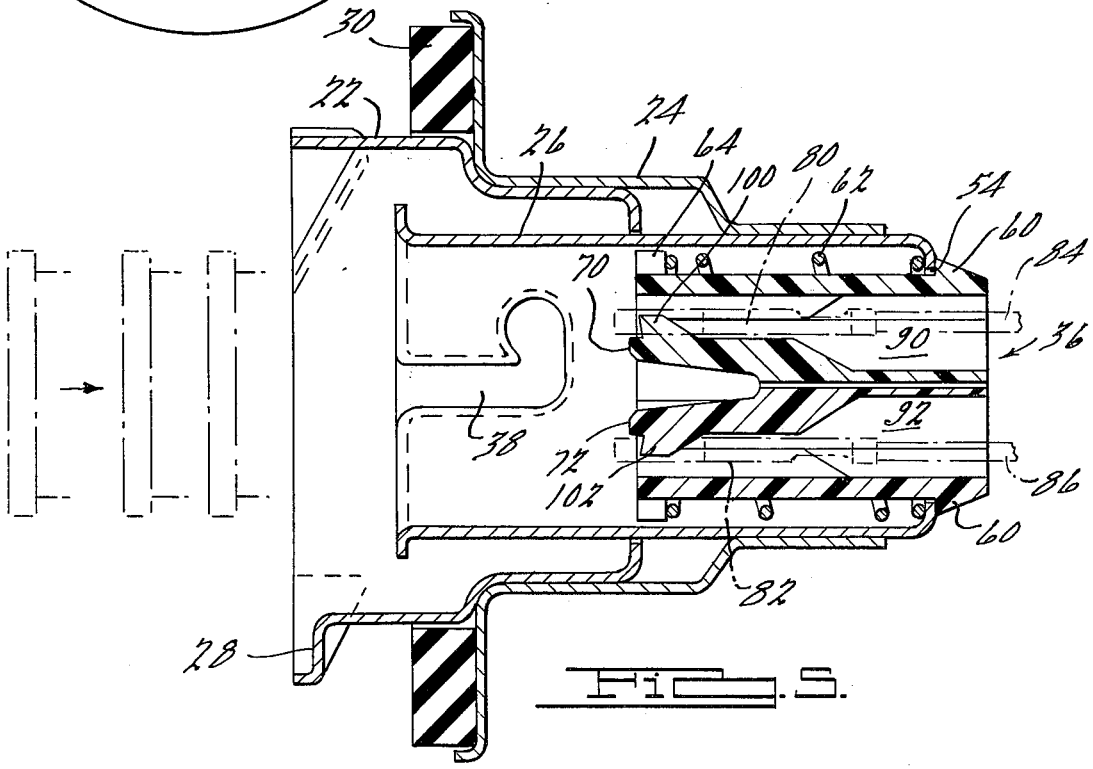
FIG. 5 is a cross-sectional view taken generally along line 5—5 in FIG. 1.
Figure 6:
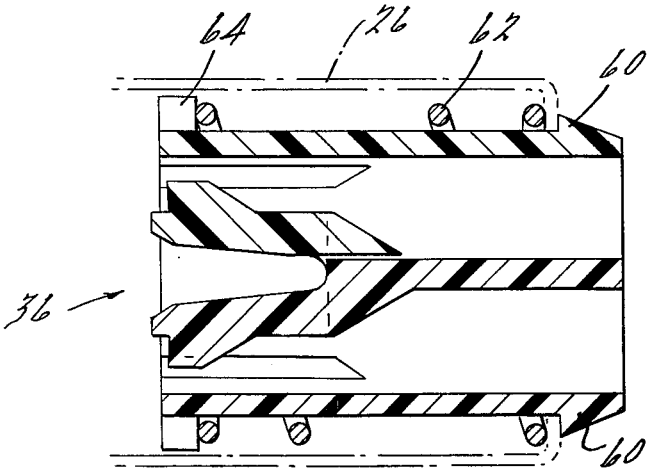
FIG. 6 is an enlarged cross-sectional view, similar to FIG. 5, of a two-part core member.
Figure 7:
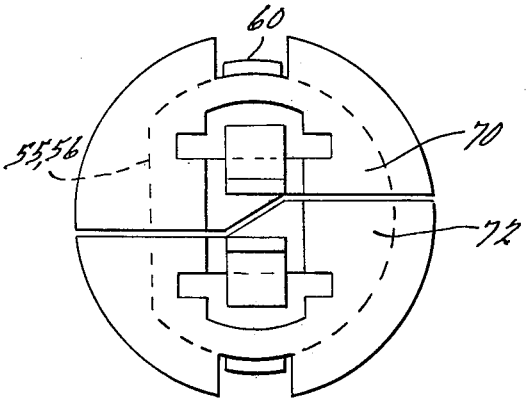
FIG. 7 is an enlarged view of the bulb-accepting end of the improved split core member.
Figure 8:
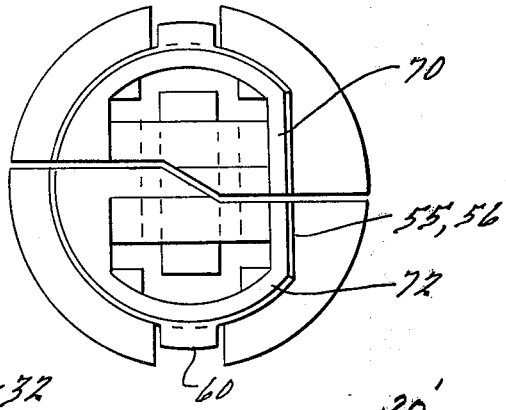
FIG. 8 is an enlarged view of the terminal accepting end of the improved split core member.

The core member 36 is inserted into the socket housing 20 through its open end, as shown by the dashed outlines and arrow in FIG. 5. At least one, and preferably two, locking tabs 60 are provided on the lower end of the core member 36 to hold it securely in place in the housing. The locking tabs 60 snap-lock over the end of the inner tubular member 26, as is shown in FIGS. 5 and 6.

A coil spring 62 biases the core member 36 in the housing 20 and maintains it in place. The spring 62 also accommodates the necessary "lost motion" so that the core member 36 can be depressed slightly when the bulb 34 is inserted in place and then be pressed firmly against the bulb 34 to maintain the necessary electrical contact pressure. A flange 64 is provided on the upper end of the core member 36 to provide a seat or bearing surface for the spring 62.

The core member 36 comprises two sections 70 and 72, each resembling one-half of a cylinder cut lengthwise. This feature allows the sections 70 and 72 to move relative to one another in the axial direction to make contact with uneven bulb contacts. The sections 70 and 72 are adapted to fit in novel interfitting relationship with each other so that when they are placed together, a cylindrical core member 36 is formed. The core member 36, and thus the individual sections 70 and 72, are preferably made of a plastic material such as nylon, acrylonitrile butadiene styrene (ABS), polyethylene, polystyrene, or the like. Nylon is commonly used in such automotive parts and is a satisfactory material to use in the present invention.

As shown in FIGS. 2, 3, 4, 7 and 8, the sections 70 and 72 are not separated along a single plane in the center of the core member 36. Instead, the split between the two sections 70 and 72 is step-like and a plurality of plane surfaces are formed. This provides better mating and positioning surfaces for the sections 70 and 72 when they are assembled to form the core member 36.

When the lamp socket is assembled, the core sections 70 and 72 are placed together forming the core member 36, the coil spring 62 is positioned around the core member 36 making a three-piece composite assembly, and the composite assembly is then inserted and snap-locked into place in the socket housing 20.

Figure 4:
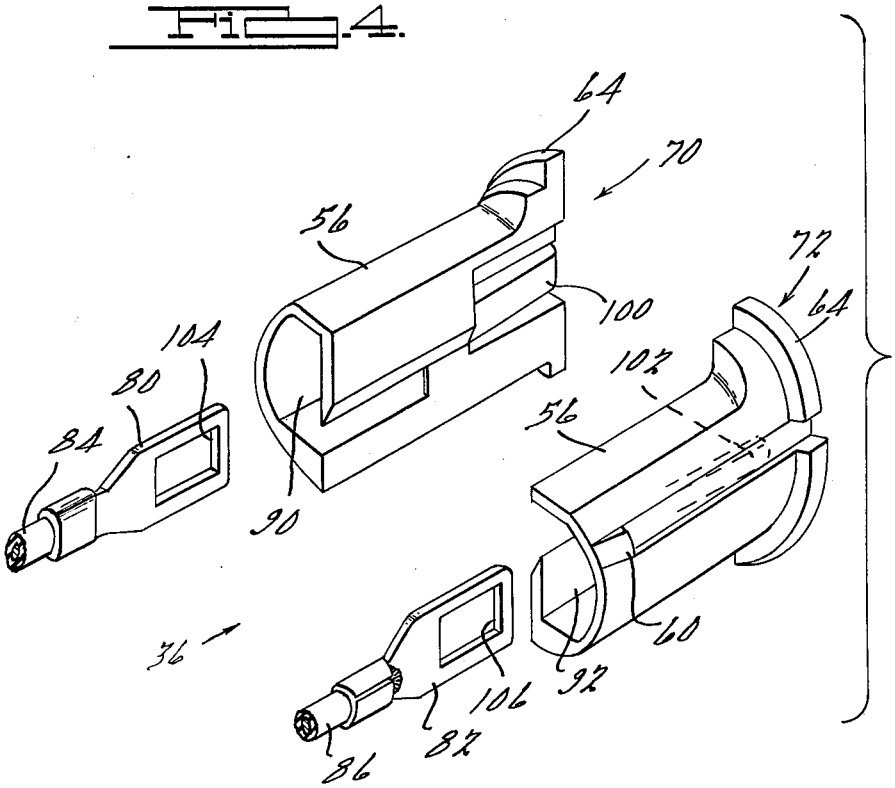
FIG. 4 is a perspective exploded view of the two-sectioned core member.
Figure 10:
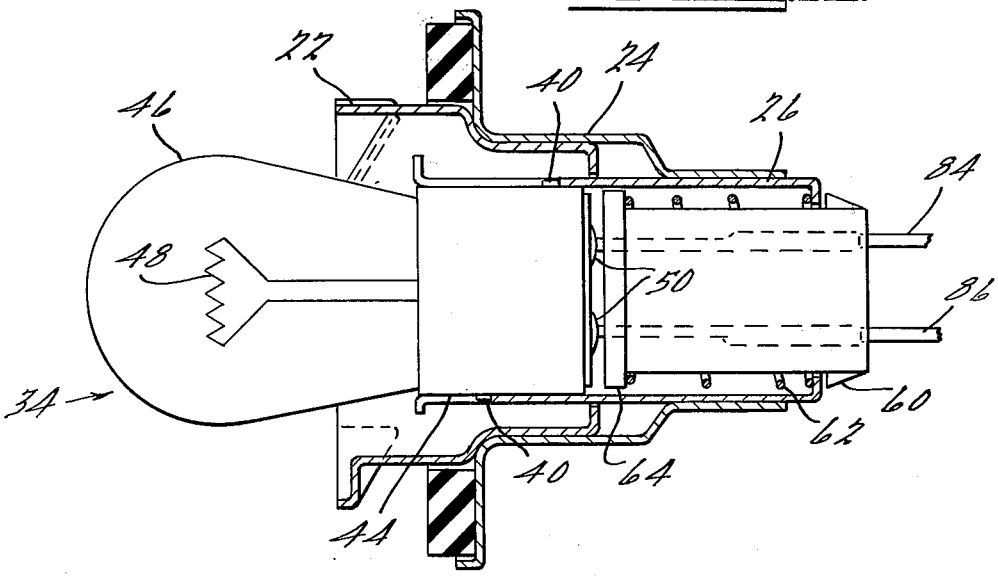
FIG. 10 is a cross-sectional view of the inventive lamp socket with a bulb positioned in it and ready for use.

The terminals or contacts used with the lamp socket are preferably flat or spade terminals as shown in FIG. 4. The spade terminals 80 and 82 are connected to the appropriate wires 84 and 86 in the wiring harness (not shown) of the vehicle. This can be done at any time during the assembly of the wiring harness. The spade terminals are crimped onto the wires in the conventional manner. Thus, after the light fixtures on the vehicle are assembled, the terminals necessary for each light fixture can be quickly and easily attached and secured in place from the rear of the socket housing.

Grooves or passageways 90 and 92 are provided in the core sections 70 and 72, respectively, for the acceptance of the spade terminals 80 and 82. Locking tabs 100 and 102 are provided on the core sections 70 and 72, respectively, for snap-locking into corresponding mating apertures 104 and 106 in the spade terminals 80 and 82.

Thus, after the core member 36 is positioned in the socket housing 20, and either before or after the improved lamp socket is positioned in the light fixture of the vehicle, the spade terminals 80 and 82 attached to the wires 84 and 86 are inserted in the passageways 90 and 92 in the core sections 70 and 72 and snap-locked into place. When the terminals 80 and 82 are in position, the ends thereof protrude beyond the end of the core member 36 to provide direct electrical connection with the terminals 50 on the bulb 34.

When the bulb 34 is positioned in the lamp socket, the pushing and turning forces necessary to fix it in its final position cause the contact terminals 50 to wipe over the ends of terminals 70 and 72. Since the ends of the spade terminals are generally long and thin in cross-section and thus relatively "sharp", as compared with the flattened generally circular terminals commonly in use today, the ends cut through and remove any oxidation or film which may exist on the bulb terminals 50 and thus insure a good electrical connection. This wiping and cutting action is an improvement over the wiping and sliding action achieved in known lamp sockets.

Also, the two core sections 70 and 72 are color coded. For example, one is formed of a light color, such as white, and the other mating half is formed of a dark color, such as black. This enhances accuracy of assembly by giving visual assurance that the wires from the wiring harness are inserted in the appropriate passageways in the core member and make contact with the proper terminals on the bulb 34.

It is also possible for the core member 36 to be comprised of a single section having only one terminal. A single sectioned core is needed where the light fixture on the vehicle accepts a single-stage bulb having a single contact thereon. This embodiment of the invention is shown in FIG. 9.

Figure 9:
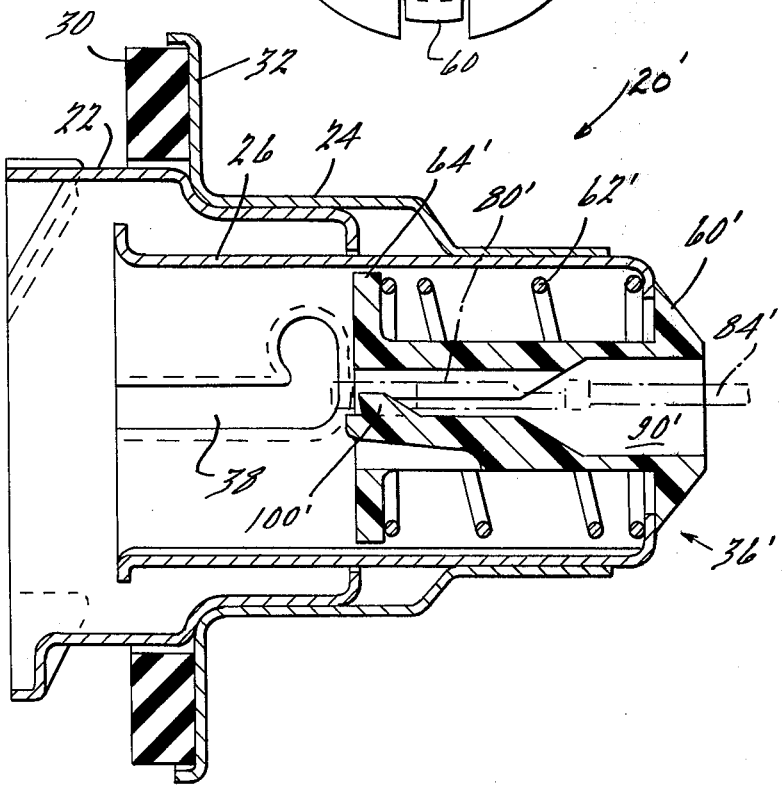
FIG. 9 is a cross-sectional view of another embodiment of the invention utilizing a one-piece core member.

As illustrated in FIG. 9, the socket housing 20′ and the various elements thereof are generally similar to those described above. The core member 36′, however, comprises a single section having one or more locking tabs 60′ which are similar in function to the locking tabs 60 described above. Coil springs 62′ and flange 64′ also are similar to the corresponding parts described above.

One spade terminal 80′, which is similar to terminal 80, is provided and is inserted in passageway 90′ in the core member 36′. A locking tab 100′ positions and holds the spade terminal 80′ in place. The function, assembly and operation of this embodiment is similar to the two-sectioned core member lamp socket described above, except that only one terminal 80′ is provided and utilized.

Although the invention has been described with respect to certain embodiments, it is understood that numerous modifications and changes may occur to those skilled in the art and that any such modifications and changes are included within the scope of the invention as defined by the following claims.

I claim:

1. A lamp socket comprising a socket housing, a core member made of two like sections insertable into said housing in one direction and having at least one passageway in each section, said housing being adapted to accept a light bulb in said one direction, said bulb having two contacts, a pair of relatively thin flat rectangular terminals, each having a laterally extending end face and an aperture therethrough spaced from said end face, said terminals being directly attached to electrical conductors, respectively, said terminals adapted to be inserted in the passageway of each section of said core member in a direction opposite to said one direction with the end faces thereof extending beyond said core member in lamp contact engaging position, and a locking tab within each said core member section extending into the aperture of the terminal therein for securing said terminals within said passageways.

2. The lamp socket described in claim 1 further comprising edge means on said flat end faces located beyond the core member for scraping and cleaning the contacts on said light bulb when said light bulb is inserted into said housing and rotated relative to said terminals.

3. The lamp socket described in claim 1 further comprising coiled spring means surrounding the two like parts of said core member to retain them in unit relation.

4. The lamp socket described in claim 3 further comprising a flange on said core member, said spring means being positioned between said flange and said housing for encompassing said two core member sections and providing a lost motion connection to maintain contact pressure between the lamp contacts and spade terminals.

* * * * *